US007823656B1

(12) United States Patent
Williams

(10) Patent No.: US 7,823,656 B1
(45) Date of Patent: Nov. 2, 2010

(54) METHOD FOR MONITORING DRILLING MUD PROPERTIES

(75) Inventor: John H. Williams, Broken Arrow, OK (US)

(73) Assignee: NCH Corporation, Irving, TX (US)

( * ) Notice: Subject to any disclaimer, the term of this patent is extended or adjusted under 35 U.S.C. 154(b) by 93 days.

(21) Appl. No.: 12/358,292

(22) Filed: Jan. 23, 2009

(51) Int. Cl.
*E21B 21/08* (2006.01)

(52) U.S. Cl. ..... 175/38; 175/66; 175/206

(58) Field of Classification Search ..... 175/38, 175/66, 206
See application file for complete search history.

(56) References Cited

U.S. PATENT DOCUMENTS 3,473,368 A * 10/1969 Roper ..... 73/54.04
4,557,142 A * 12/1985 Hensley et al. ..... 73/152.19
4,794,534 A 12/1988 Millheim
4,904,603 A 2/1990 Jones et al.
5,306,909 A * 4/1994 Jones et al. ..... 250/255
5,474,142 A 12/1995 Bowden
5,554,804 A 9/1996 Delatorre et al.
5,732,776 A 3/1998 Tubel et al.
5,864,772 A 1/1999 Alvarado et al.
6,021,095 A 2/2000 Tubel et al.
6,101,444 A 8/2000 Stoner
6,233,524 B1 5/2001 Harrell et al.
6,293,356 B1 9/2001 King et al.
6,427,785 B2 8/2002 Ward
6,456,902 B1 9/2002 Streetman
6,609,067 B2 8/2003 Tare et al.
6,662,110 B1 12/2003 Bargach et al.
6,691,779 B1 2/2004 Sezginer et al.
6,693,553 B1 2/2004 Ciglenec et al.
6,732,052 B2 5/2004 Macdonald et al.
6,766,854 B2 7/2004 Ciglenec et al.
6,808,028 B2 10/2004 Woodburn et al.
6,832,158 B2 12/2004 Mese et al.
6,892,812 B2 5/2005 Niedermayr et al.
6,943,697 B2 9/2005 Ciglenec et al.
6,944,547 B2 9/2005 Womer et al.
6,967,589 B1 11/2005 Peters
7,044,237 B2 5/2006 Leuchtenberg
7,119,572 B2 10/2006 Malik et al.
7,154,411 B2 12/2006 Ciglenec et al.
7,178,607 B2 2/2007 Mayes
7,236,342 B2 6/2007 Vazach et al.
7,263,459 B2 8/2007 Ito et al.
7,278,496 B2 10/2007 Leuchtenberg
7,350,597 B2 4/2008 Reitsma et al.

(Continued)

*Primary Examiner*—William P Neuder
(74) *Attorney, Agent, or Firm*—Locke Lord Bissell & Liddell, LLP

(57) ABSTRACT

A method for monitoring drilling mud properties, the drilling mud being transported through a well drilling system and stored in a mud pit includes directing the flow of drilling mud in the well drilling system from the mud pit to a sampling unit. A sample of the drilling mud from the mud pit is obtained. At least one mud property of the sampled drilling mud is sensed automatically and in real time to obtain a condition value. If the condition value is within a set point range for the mud property the drilling mud is returned to the mud pit. The drilling mud is directed to a centrifuge for adjustment of the mud property if the condition value is outside the set point range. The drilling mud from the centrifuge is returned to the mud pit after the mud property has been adjusted.

10 Claims, 3 Drawing Sheets

U.S. PATENT DOCUMENTS

| | | | |
|---|---|---|---|
| 7,367,411 | B2 | 5/2008 | Leuchtenberg |
| 2002/0171560 | A1 | 11/2002 | Ciglenec et al. |
| 2003/0079912 | A1 | 5/2003 | Leuchtenberg |
| 2003/0220742 | A1 | 11/2003 | Niedermayr et al. |
| 2004/0016572 | A1 | 1/2004 | Wylie et al. |
| 2005/0189142 | A1 | 9/2005 | Garcia et al. |
| 2006/0037781 | A1 | 2/2006 | Leuchtenberg |
| 2006/0113110 | A1 | 6/2006 | Leuchtenberg |
| 2006/0175090 | A1 | 8/2006 | Reitsma et al. |
| 2007/0087927 | A1 | 4/2007 | Scott et al. |
| 2007/0151762 | A1 | 7/2007 | Reitsma |
| 2007/0151763 | A1 | 7/2007 | Reitsma et al. |
| 2007/0227774 | A1 | 10/2007 | Reitsma et al. |
| 2008/0024319 | A1 | 1/2008 | Close |
| 2008/0035375 | A1 | 2/2008 | Burkhard et al. |
| 2008/0060846 | A1 | 3/2008 | Belcher et al. |
| 2008/0302570 | A1 | 12/2008 | deBoer |

* cited by examiner

METHOD FOR MONITORING DRILLING MUD PROPERTIES

TECHNICAL FIELD OF THE INVENTION

The present invention relates to oil and gas production, and more particularly to a method for monitoring and adjusting in real time the conditions and properties of drilling mud.

BACKGROUND OF THE INVENTION

In the oil and gas industry certain personnel, such as a Mud Hand, Derrick Hand and or Mud Engineer, are called upon to measure the current conditions of drilling mud properties. Some of the properties checked are weight, viscosity and pH just to name a few of the most common measurements taken. These measurements are taken by the Derrick Personnel every thirty (30) minutes and by the Mud Engineers at least once a day. These readings are then written down and given to the Tool Pusher and or the onsite Company Man. The Tool Pusher records these readings in a format that can be shared with the Corporate Supervisors and Engineers.

These measurements, however, can be inaccurate due to mechanical error e.g., wear, corrosion or filming of parts, etc.; human error e.g., misreading; and other conditions e.g., bad weather, entrained gases, etc. Adding to these problems is that calibration and validation of the instruments used to run the test are generally not performed. Moreover, there may be a significant delay in getting the information from the Derrick Hand and or Mud Engineer to the intended audience. This delay can have an effect on the quality of the of the well, the drilling speed, cost to drill to depth, sticking of a drill bit, a well wall cave in, and affect the ability to keep the gas from blowing out the hole and the yield of the well.

Thus there is no current system that can monitor the properties of the mud in real-time mode and give the needed predictive warnings long before an event takes place-such as the weight rising too fast and overloading the centrifuge and causing the system to pack out and become inoperable until service repairs are made to the unit. This delay will then cause the rig greater expense to operate. The mud weight is usually checked only once or twice an hour and yet changes to drilling mud occur every second. If a reading is missed then no corrective action can take place until after a reading is finally taken. Likewise if there is bad weather then the amount of manual measurements and actual accuracy of the measurements will become affected since most of the measurements are performed out in the open without shelter. Similarly, there is no process by which the recipient of the information can verify whether or not the Mud Hand or Mud Engineer actually took the measurement or the method by which a measurement was taken. By way of example the Mud Hand could be inebriated or drugged while taking and recording measurements, and thus later report erroneous information. Furthermore, the information that the Mud Hand and or Mud Engineer gather may lack accuracy and precision. Also, any information gathered after hours may introduce days of delay.

The corrosion rings that are used as corrosion coupons to help measure the corrosion rate caused by the drilling fluid must be manually inserted and removed with the date and time for each event noted on the corrosion ring's paper envelope. That paper envelope must not be lost or damaged by getting wet because the envelope has the starting information about that ring that is needed when the ring is being measured by the lab. If that information is lost or unreadable then the ability to run the corrosion rate is lost.

Since no two corrosion rings are the same, it is very important to maintain the information about the ring that is used for the corrosion kept in a safe place and not lost or damaged. These corrosion rings are generally in place for two hundred and forty hours. The provider of the ring is dependent on the rig hand to remove the ring and store it in a safe place and then insert the next ring and note the date and time it was inserted. If the ring information is off then the corrosion rate will be inaccurate. These corrosion rings can only indicate the amount of corrosion and not when the corrosion actually occurred or the highest rate and lowest rate of corrosion during that period. Since the drilling environment and the properties are dynamic and constantly in changing states, the only value that the corrosion ring has is some what general and after the fact.

The ring must be sent offsite and evaluated and then the information sent back to the rig personnel. By that time, another two hundred and forty hours could have lapsed and the drilling for that well could have been completed. The need for corrosion protection of the drilling pipe is added on a constant basis and may be never adjusted, since no readings have been taken. The practice of feeding corrosion chemicals has been largely based on a daily amount, for example, around fifteen gallons and there may be no verification that any corrosion chemicals were added or when and how.

The equipment used to help remove the cutting produced by drilling through the formation that must be removed in order to reuse the existing mud and avoid the cost of making new mud is manually driven by manual adjustments that the Rig Hand and or Mud Hand makes. Since the Rig Hand and/or Mud Hand only take a few measurements and are always behind the curve, the efficiency of these measurements will always be limited. Furthermore, certain chemistries have a stoichiometric relationship and therefore require varying feed rates due to the dynamic relationship they share in order to get the maximum end result, making it impossible for a manual adjustment to be made, since that adjustment would have to change second by second. The knowledge of the chemical polymer relationships with the required pH adjustment that are needed to run efficiently are above the knowledge base of the Rig Hand, Mud Hand, Tool Pusher, Company Man and Mud Engineer. Therefore guesses are being made and systems are running from a limited knowledge base which is driving up the cost of operating a drill rig to drill a well. Therefore, there is a need for an online monitoring system that will gather accurate information in an expedient method that the can be shared with all parties involved in the Drilling Operation.

SUMMARY OF THE INVENTION

The present invention relates to the need to know the current conditions of the drilling mud fluids' weight, viscosity, pH, % solids content and many other properties that require currently a manual measurement to be taken, for example, every sixty (60) minutes. These measurements are needed by the Tool Pusher and or Company Man for each well location that the drill rig is drilling a well on. The Tool Pusher must then report via log and email or enter the information into a system that can be reviewed by the company supervisors and engineers over that well development to be viewed from a separate location. The information is needed and desired by those who are responsible for developing and refining the products produced from the well yield that is being drilled. The conditions of the drilling mud fluids are more important than the speed of which drilling depth is occurring since these fields affect the life and quality of the well and the yield produce from each well long after the drilling has been done. Furthermore most of the liquid solid separation processes are driven by manual on/off settings based on the measurements taken. Since the machinery is manual set point driven, the machinery cannot respond to the current conditions and are therefore prone to so many problems and failures due to the constant changes in the drilling mud. Also, the additional costs are considerable due to the lack of automation which would bring the operation of the equipment used to filter the mud and try and maximize the use of the existing drilling mud without making more and or new drilling mud.

The present method monitors the conditions of the drilling fluids regardless of whether the fluid is water, oil or polymer based in compositions that will become the drilling mud. A system is connected in real-time mode to a Server and can act as a stand-alone device without being connected to the server. The system collects various properties by running the Drilling fluids through a Control Loop which the monitors the conditions of the drilling mud. The System can be built out as a fixture on any rig or on a trailer that may travel from a rig location to a different location where a greater need for the information may exist. The system can collect the value of any number of the sensors readings and then make control adjustments to help maintain the desired properties of the drilling mud.

The collection of Data can be accessed from anywhere an internet connection exists from PC to Smart Phones and or PDA's. The control and functions of the system can be changed, calibrated, tuned and reset either remotely or locally. Each system is set up and configured for each job that is required at each drill site, since the needs from rig and drill site might change based on the differences that can occur while drilling through similar formations.

The present method helps with solids removal and centrifuge efficiencies regardless if the centrifuge is a variable drive or standard drive unit by monitoring the dramatically changing conditions. With this information the system will precondition and pre-treat the fluids going to the centrifuge into the optimal state so as to maximize the benefits of the centrifuge and minimize the down time of the centrifuge, while extending the life of the centrifuge. This operation will minimize the demand for energy to run and operate a centrifuge and reduce the amount out of service time and man power needed to operate and maintain the centrifuge. The present method will also minimize the amount of chemicals needed and maximize the use of all chemistries since it can sense and measure the conditions of the drilling mud while adding the required chemistry needed for the desired adjustment.

BRIEF DESCRIPTION OF THE DRAWINGS

For a more complete understanding of the present invention and for further advantages thereof, reference will now be made to the following Description of the Preferred Embodiments taken in conjunction with the accompanying Drawings in which.

DETAILED DESCRIPTION OF THE PREFERRED EMBODIMENTS

The present invention monitors the conditions of drilling mud in a continuous real-time mode that is on line. A system for practicing the present method for monitoring drilling mud is referred to herein as the MudStar™ system. The present method is referred to herein as the MudStar™ process.

The present method monitors drilling mud properties (hereinafter "Properties") including but not limited to those listed in Table 1:

TABLE 1

| |
|---|
| pH |
| Density |
| Weight |
| Viscosity |
| % Solids |
| Water Content % By Volume |
| Dissolved Oxygen |
| Hydrogen Sulfide |
| Foaming Condition |
| Entrained Gases |
| Biological Content and loading |
| Free and Total Chlorine |
| Free and Total Bromine |
| Chlorine Dioxide |
| Oxygen Reducing Potential |
| Conductivity |
| Temperatures |
| Flow Rate |
| Flow Volume |
| Corrosion General Metal Specific Rates |
| % Corrosion Pitting |

The present method further monitors drilling mud operating conditions (hereinafter "Conditions") including, but not limited to those listed in Table 2:

TABLE 2

| |
|---|
| Centrifuge Efficiency |
| Volume and Flow Rate of Drilling Mud to Centrifuge |
| Volume and Flow Rate of Water from Centrifuge |
| Volume and Consumption of Centrifuge Solids Removal |
| Volume and Consumption of Make up Water |
| Volume and Consumption of Make up Diesel Fuel |
| Volume and Consumption of Caustic |
| Volume and Consumption of Acid |
| Volume and Consumption of Polymer |
| Volume and Consumption of Chemicals |

The present method also monitors the quality and level of caustic, acid and polymer.

The present method further monitors and controls various pumps including, but not limited to, acid, caustic, polymer, chemical, centrifuge effluent and centrifuge influent pumps.

A MudStar system unit (hereinafter "Unit") located on or at a drilling site includes a wireless GPS/GRPS router that is connected to a MudStar PLC that reports its current location to the server and the current conditions of the drilling mud that then can be viewed by any one who has a need for that information.

Figure 1A:
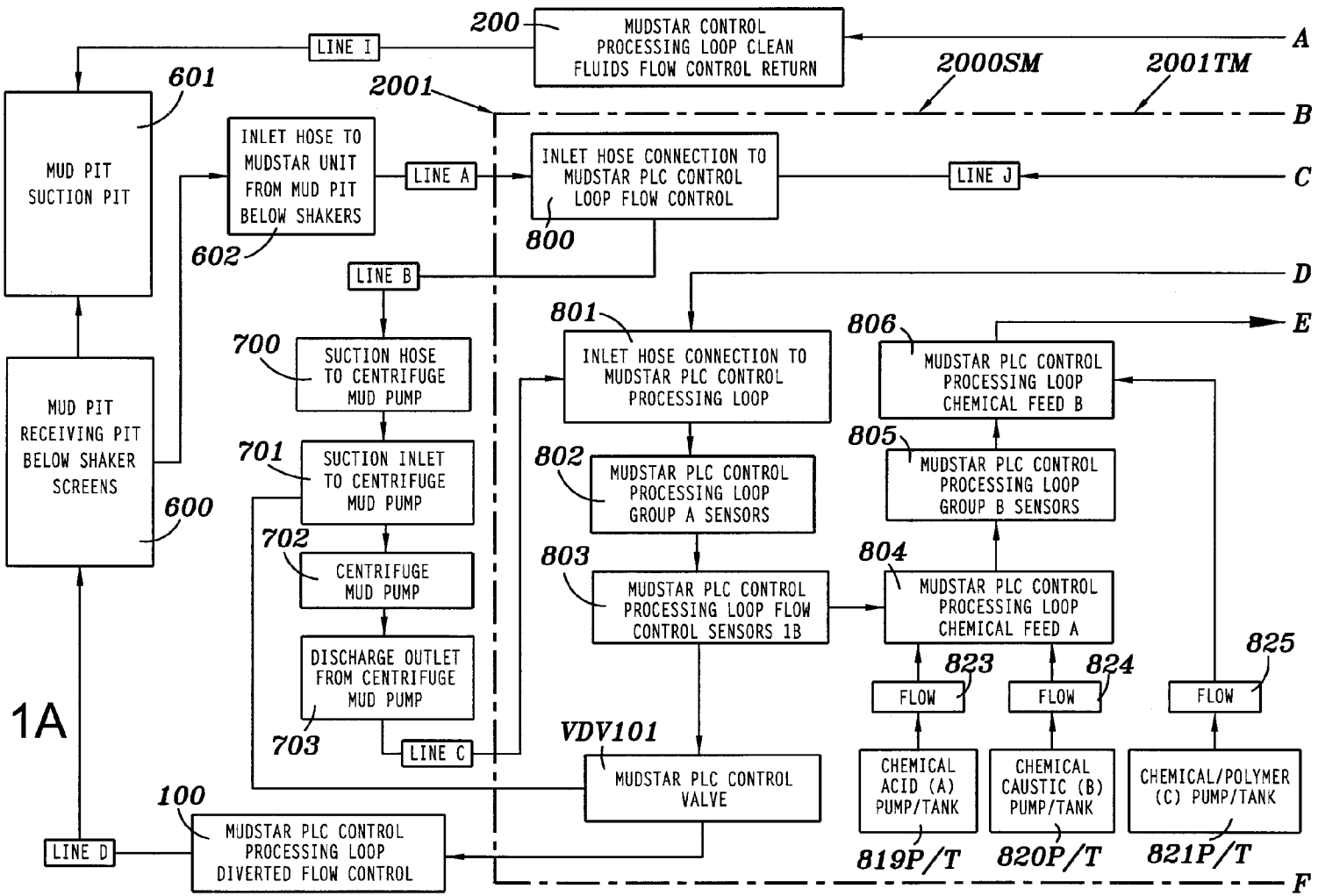
FIGS. 1A and 1B are a block diagram of a system used to perform the present invention, the Figures to be placed side by side with drawing sheet connectors A, B, C, D, E and F in alignment.
Figure 1B:
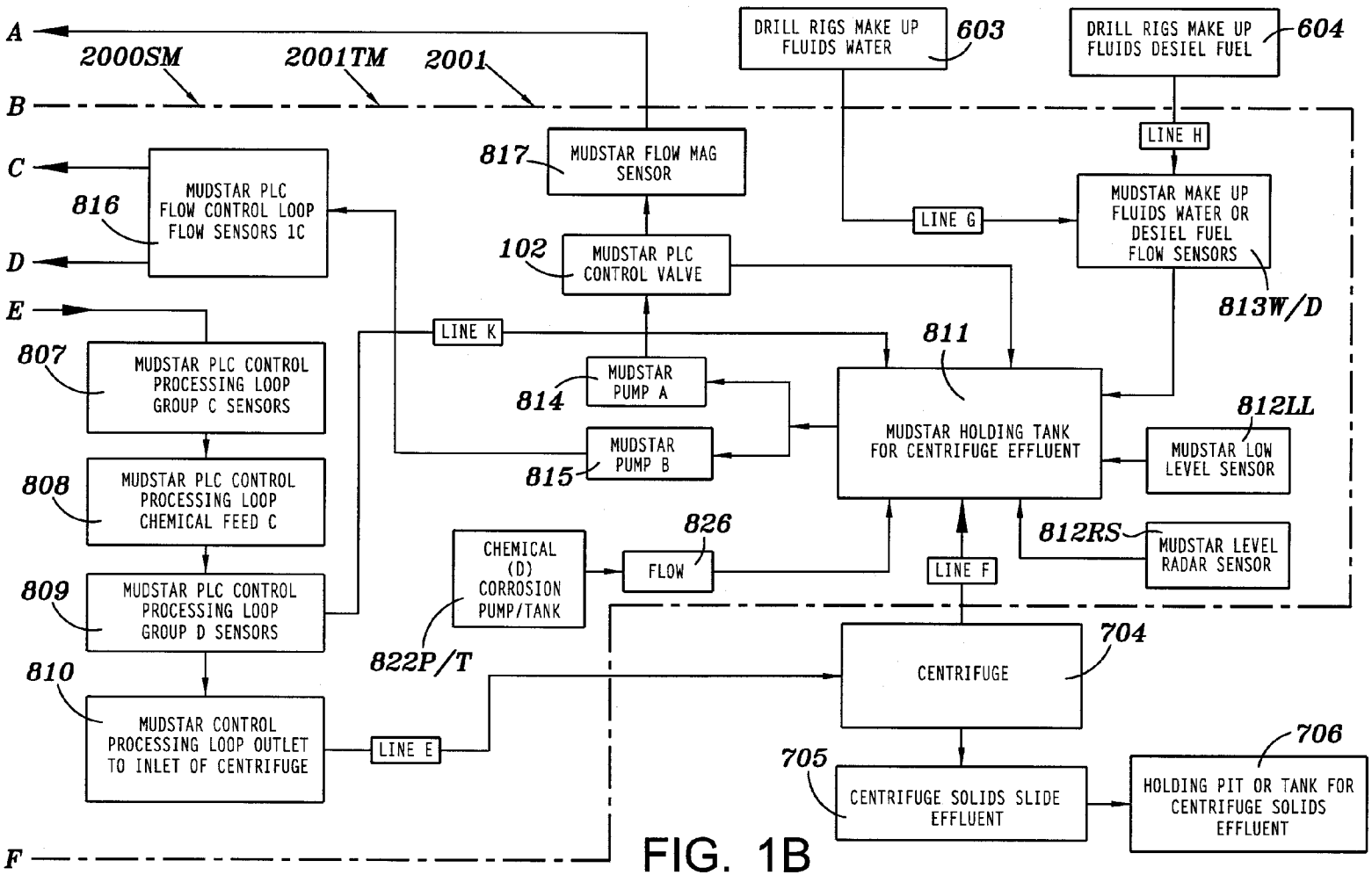

Referring to FIGS. 1A and 1B, the MudStar system for monitoring and controlling the conditions of Drilling Mud includes a mobile or fixed 2000SM, 2001TM MudStar Unit (hereinafter collectively referred to as "Unit 2001"). Unit 2001 is located on or near a Drill Rig where the drilling fluid, that is normally plumbed into a 704 centrifuge is now plumbed into the inlet of the 800 MudStar Flow Control Unit. An additional 700, Line B line and or Hose from the 800 MudStar Flow Control Unit is now run to the suction side of the 701 centrifuge mud pump. The Discharge Line C line and or hose from the 703 centrifuge mud pump is now plumbed into the 801 inlet of MudStar Unit Control Loop Stage 1. Another Line E line and or hose is plumbed from the discharge of the 810 MudStar Control Loop Stage 3 to the inlet of the 704 centrifuge. The discharge Line F line and or hose of the 704 centrifuge is connected and drained into the 811 MudStar Holding Tank. MudStar Holding Tank 811 will hold onto all effluent coming from the 704 centrifuge. Another Line I line and or hose from the 811 MudStar Holding Tank is plumbed from this tank back into the 601 Mud Suction Pit. An additional Line D line and or hose runs from the VDV101 MudStar Control Loop Stage 1 Unit back into the 600 Mud Reserve Pit. A make u Line G line and or hose for 603 water and or a make up line H line and or hose for 604 diesel fuel that is used in the make up of the Drilling Mud is plumbed into the 813W, 813D MudStar Units Make Up Flow Sensors.

Figure 2:
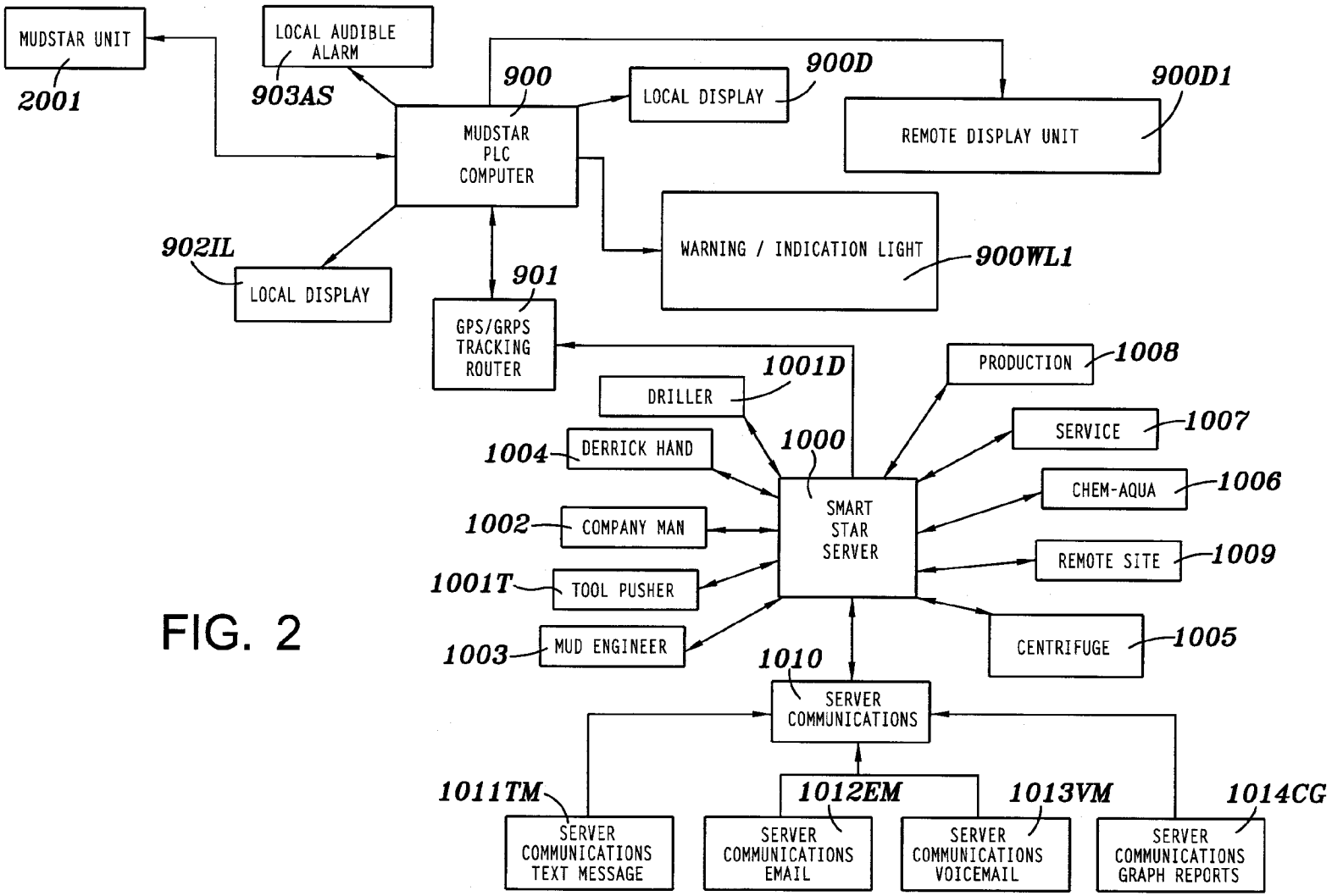
FIG. 2 is a block diagram of a PLC computer and server used with the present method.

The MudStar Unit 2001 has the control of the flow of the Drilling Mud and can direct the flow of the liquid coming from the 600 Mud Reserve Pit and after the first pass of sensors in the 801, 802, 803 MudStar Control Loop Stage 1 the 900 MudStar PLC Computer (FIG. 2) will either continue with the flow of the Drilling Mud thru the rest of the 804 thru 809 MudStar Unit or it will divert the flow back to the 600 Mud Reserve Pit thru Line D. This is based on a set point control that is input into the 900 MudStar PLC/Computer Unit by any number of the onsite personnel such as the 1002 Company Man, 1001T Tool Pusher, 1001D The Driller, Mud Hand, 1004 Derrick Hand and or 1003 Mud Engineer. The set point control can be input into and controlled and viewed from a 1008 Productive Company remote site, 1007 Service Company, 1006 Chem-Aqua Company, 1005 Centrifuge Company, and 1009 Remote site using the 1000 SmartStar Server.

The 900 MudStar PLC/Computer is connected to all components within Unit 2001. If the 900 MudStar PLC/Computer detects a condition that is above and or below the input set point and or differential it will divert a portion or all of the flow of the Drilling Mud from the VDV101 MudStar Control Loop Stage 1 back to the 600 Reserve Pit. While the flow of the Drilling Mud is being diverted the 900 MudStar PLC/Computer will allow an amount of the Centrifuge Effluent from the 811 MudStar Centrifuge Effluent Holding Tank to be mixed back into the Line B inlet line and or hose for the suction line on the 701 centrifuge mud pump. The rate, volume and control of the Drilling Mud being diverted and the Blending of the 810 Centrifuge Influent is being controlled by the 900 MudStar PLC/Computer. This blending of the Drilling Mud is continued until the Drilling Mud condition is back with in the normal operating range. During this blending function the 900 MudStar PLC/Computer Unit will show that blending is occurring on its 900D local display and 900D1 remote display, as well as turn on an indication 902IL light that the blending relay is opened. The 900 MudStar PLC will report to the 1000 SmartStar Server using the 901 router. The 1000 SmartStar Server will send out an email, text message and a graph customer report of the blending event by using the internet.

If the Drilling Mud that is flowing to the 801, 802, 803 MudStar Control Loop Stage 1 is below the low level need to be cut by the Centrifuge then a by pass Line K line is opened up to avoid sending the Drilling Mud to the 704 Centrifuge and is then pumped directly into the 811 MudStar Centrifuge Effluent Holding and or back to the 600 Drilling Mud Reserve Pit if the operators decide that they want to keep the solids in the 600 Drilling Mud Reserve Pit stirred up and to help keep them from setting in the bottom of the 600 Drilling Mud Reserve Pit. The continual flow of Drilling Mud to the 2001 MudStar Unit is necessary since the 2001 MudStar Unit is treating many other number of conditions such as but not limited to, S1 Corrosion, Biological, Foaming, Hydrogen Sulfide, Oxygen and many more. This treated Drilling Mud Rate and Volume is being continuously monitored by the 900 MudStar PLC/Computer. 900 MudStar PLC/Computer is also adding make up 603 water and or 604 diesel fuel, while controlling the rate and or volume of the make up water and or diesel fuel by 813 MudStar Flow Control from any number of locations from local and or remote through the SmartStar Server.

Once the operator has connected the 2001 MudStar Unit to the Drilling Rig and turned the flow on allowing the mud to flow thru the 800 MudStar Flow Control the 900 MudStar PLC/Computer will sense the flow of the Drilling Mud going thru the control loop as it pass the first set of 801, 802, 803 sensors in stage 1 which will sense any amount of flow. During this initial flow event the default setting for the Drilling Mud will be to send it back to the 600 Drilling Mud Reserve Pit. This way a base line of the Drilling Mud can be established before starting any type of treatment and or adjustments.

Once the flow is sensed and a base line has been verified the 900 MudStar PLC/Computer will start sending flow through the MudStar Control Loop 801 thru 803 Stages 1, 804 thru 806 Stages 2 and then 807 thru 809 Stage 3 for treatment and conditioning of the Drilling Mud to the set point as determined by the 900 MudStar PLC/Computer. The Drilling Mud will be measured and or sensed as it flows thru 801 thru 803 Stage 1 for the S1 pH level the 900 MudStar PLC/Computer will then add chemistries to adjust the pH of the Drilling Mud to the desired set point. After the initial pH measurement the 900 MudStar PLC/Computer will calculate the amount of 819P Acid and or 820P Caustic that will be needed to bring the pH into the target range. The 900 MudStar PLC/Computer will know and use the Rate Of Flow and the Volume Of The Drilling Mud to then regulate the variable drive chemical pump to feed the proper amount of Chemistry 819 Acid and or 820 Caustic to bring the pH within the target range. The 900 MudStar PLC/Computer will also measure the thru put of the 819P Acid and or 820P Caustic due to the 823, 824 Flow Trackers which measures the rate and volume of the liquid leaving the variable drive 819P, 820P chemical pumps.

This information from the 819P, 820P Variable Drive Chemical Pumps is collected with in the 900 MudStar PLC/Computer and then is used for Chemical Feed Verification, Consumption Rate which is the reported in hourly and or daily volumes to the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports.

The 823, 824 Flow Trackers will also be used by the 900 MudStar PLC/Computer to verify that the 819 MudStar Variable Drive Pump assigned to a designated relay that has been turn on is actually running and delivering the programmed amount of chemistries. If the 900 MudStar PLC/Computer does not receive a signal from the 823, 824 Flow Trackers within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports.

The 900 MudStar PLC/Computer can then also disable the relay to stop the running of a 819, 820 chemical pump that could then be leaking on the ground and or all over the equipment and or the Drill Rig. The 900 MudStar PLC/Computer also has a 812RS MudStar Level Radar Sensor and a 812LL MudStar Low Level Sensor and a L3LL MudStar Chemical Level Sensors on top of the 819T, 820T, 821T, 822T chemical holding tanks measuring the level within the holding tanks and also on the 811 MudStar Holding Tank. These sensor are then sending this information to the 900 MudStar PLC/Computer. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates. All of this is being done to the Drilling Mud as the Drilling Mud is flowing thru the 801 thru 809 MudStar Control Loop.

The Drilling Mud will then pass thru a final set of sensors in the 807 thru 809 MudStar Control Loop Stage 3 and the 900 MudStar PLC/Computer will sense and or measure the pH of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

While the aforementioned process is taking place a simultaneously a standard process for measuring the S1 Weight of the Drilling Mud is taking place as the Drilling Mud passes thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Weight can be established before starting any type of treatment and or adjustments.

Once the flow is sensed and a base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Weight set point as determined by the customer. The Drilling Mud will be measured and or sensed for Weight and the 900 MudStar PLC/Computer will then add a chemistry and or a flow stream of a lighter fluid to cut and or lean the Weight of the Drilling Mud.

The MudStar Process may use any of the following and or combination thereof such as the effluent liquid from the 704 centrifuge, 821P chemicals, 603 make up water and or 604 diesel fuel to adjust the Drilling Mud Weight to the desired set point. These Fluids are collected and or Stored in the 811 MudStar's Effluent Holding Tank. After the initial Drilling Mud Weight measurement the 900 MudStar PLC/Computer will calculate the amount of Chemistries and or Cutting Fluids that will be needed to bring the Drilling Mud Weight into the target range. The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Weight within the target range as determined by a set point.

The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports. The 900 MudStar PLC/Computer can then also disable the relay to stop the running of a 821P Chemical Pump and or 815, 814 Transfer Pump that could then be leaking on the ground and or all over the equipment and or Drill Rig.

The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to ensure the system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Weight of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which then fall down the 705 Centrifuge Solids Effluent Slide to be collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously a standard process for measuring the S1 Viscosity of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Viscosity can be established before starting any type of treatment and or adjustments.

Once the flow is sensed and a base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Viscosity set point as determined by the customer. The Drilling Mud will be measured and or sensed for Viscosity and the 900 MudStar PLC/Computer will then add a chemistry and or a flow stream of a lighter fluid to increase and or decrease the Viscosity of the Drilling Mud.

The MudStar Process may use any of the following and or combination thereof such as the effluent liquid from the 704 Centrifuge, 821P chemicals, 603 make up water and or 604 diesel fuel to adjust the Drilling Mud Viscosity to the desired set point. These Fluids are collected and or Stored in the 811 MudStar's Effluent Holding Tank. After the initial Drilling Mud Viscosity measurement the 900 MudStar PLC/Computer will calculate the amount of Chemistries and or Cutting Fluids that will be needed to bring the Drilling Mud Viscosity into the target range. The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Viscosity within the target range as determined by a set point.

The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Viscosity of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously an optional process for measuring the S1 Percent % Solids of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Percent % Solids can be established before starting any type of treatment and or adjustments.

Once the flow is sensed and a base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Percent % Solids set point as determined by the customer. The Drilling Mud will be measured and or sensed for Percent % Solids and the 900 MudStar PLC/Computer will then add a chemistry and or a flow stream of a lighter fluid to increase and or decrease the Percent % Solids of the Drilling Mud.

The MudStar Process may use any of the following and or combination thereof such as the effluent liquid from the 704 Centrifuge, 821P chemicals, 603 make up water and or 604 diesel fuel to adjust the Drilling Mud Percent % Solids to the desired set point. These Fluids are collected and or Stored in the 811 MudStar's Effluent Holding Tank. After the initial Drilling Mud Percent % Solids measurement the 900 MudStar PLC/Computer will calculate the amount of Chemistries and or Cutting Fluids that will be needed to bring the Drilling Mud Percent % Solids into the target range. The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Percent % Solids within the target range as determined by a set point.

The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Custom Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Percent % Solids of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously an optional process for measuring the S1 Dissolved Oxygen of the Drilling Mud is taking place as the Drilling Mud pass thru the initial part of the 801 thru 803 MudStar Control loop Stage 1 for the Dissolved Oxygen level the 900 MudStar PLC/Computer will then add chemistries to adjust the Dissolved Oxygen of the Drilling Mud to the desired set point. After the initial Dissolved Oxygen measurement the 900 MudStar PLC/Computer will calculate the amount of 822P Chemical that will be needed to bring the Dissolved Oxygen into the target range. The 900 MudStar PLC/Computer will know and use the Rate of Flow and the Volume of the Drilling Mud to then regulate the variable drive chemical pump to feed the proper amount of Chemistry 822 to bring the Dissolved Oxygen within the target range.

The 900 MudStar PLC/Computer will also measure the thru put of the 822P Chemical due to the 825 Flow Trackers which measures the rate and volume of the liquid leaving the variable drive 822P chemical pumps. This information from the 822P Variable Drive Chemical Pumps is collected with in the 900 MudStar PLC/Computer and then is used for Chemical Feed Verification, Consumption Rate which is the reported in hourly and or daily volumes to the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 823, 824 Flow Trackers will also be used by the 900 MudStar PLC/Computer to verify that the 819. MudStar Variable Drive Pump assigned to a designated relay that has been turned on is actually running and delivering the programmed amount of chemistries. If the 900 MudStar PLC/Computer does not receive a signal from the 823, 824 Flow Trackers within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 819, 820 chemical pump that could then be leaking on the ground and or all over the equipment and or the Drill Rig. The 900 MudStar PLC/Computer also has a 812RS MudStar Level Radar Sensor and a 812LL MudStar Low Level Sensor and a L3LL MudStar Chemical Level Sensor on top of the 819T, 820T, 821T, 822T chemical holding tanks measuring the level within the holding tanks and also on the 811 MudStar Holding Tank. These sensors are then sending this information to the 900 MudStar PLC/Computer. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

All of this is being done to the Drilling Mud as the Drilling Mud is flowing thru the 801 thru 809 MudStar Control Loop. The Drilling Mud will then pass thru a final set of sensors in the 807 thru 809 MudStar Control Loop Stage 3 and the 900 MudStar PLC/Computer will sense and or measure the Dissolved Oxygen of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

While the aforementioned process is taking place a simultaneously an optional process for measuring the S1Free and or Total Chlorine Residual of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Free and or Total Chlorine Residual can be established before starting any type of treatment and or adjustments.

Once the flow is sensed and a base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Free and or Total Chlorine Residual set point as determined by the customer. The Drilling Mud will be measured and or sensed for Free and or Total Chlorine Residual and the 900 MudStar PLC/Computer will then add a chemistry and or a flow stream of a lighter fluid to increase and or lean the Free and or Total Chlorine Residual of the Drilling Mud.

The MudStar Process may use any of the following and or combination thereof such as the effluent liquid from the 704 centrifuge, 821P chemicals, 603 make up water and or 604 diesel fuel to adjust the Drilling Mud Free and or Total Chlorine Residual to the desired set point. These Fluids are collected and or Stored in the 811 MudStar's Effluent Holding Tank. After the initial Drilling Mud Free and or Total Chlorine measurement the 900 MudStar PLC/Computer will calculate the amount of Chemistries and or Cutting Fluids that will be needed to bring the Drilling Mud Free and or Total Chlorine Residual into the target range.

The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Free and or Total Chlorine Residual within the target range as determined by a set point. The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Free and or Total Chlorine of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously an optional process for measuring the Free and or Total Bromine Residual of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Free and or Total Bromine Residual can be established before starting any type of treatment and or adjustments.

Once the flow is sensed and base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Free and or Total Bromine Residual set point as determined by the customer. The Drilling Mud will be measured and or sensed for Free and or Total Bromine Residual and the 900 MudStar PLC/Computer will then add a chemistry and or a flow stream of a lighter fluid to increase and or decrease the Free and or Total Bromine Residual of the Drilling Mud.

The MudStar Process may use any of the following and or combination thereof such as the effluent liquid from the 704 Centrifuge, 821P chemicals, 603 make up water and or 604 diesel fuel to adjust the Drilling Mud Free and or Total Bromine Residual to the desired set point. These Fluids are collected and or Stored in the 811 MudStar's Effluent Holding Tank. After the initial Drilling Mud Free and or Total Bromine Residual measurement the 900 MudStar PLC/Computer will calculate the amount of Chemistries and or Cutting Fluids that will be needed to bring the Drilling Mud Free and or Total Bromine Residual into the target range.

The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Free and or Total Bromine Residual within the target range as determined by a set point. The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T MudStar Chemical Holding Tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Free and or Total Bromine Residual of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously process for measuring the Chlorine Dioxide Residual of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Chlorine Dioxide Residual can be established before starting any type of treatment and or adjustments.

Once the flow is sensed and base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Chlorine Dioxide Residual set point as determined by the customer. The Drilling Mud will be measured and or sensed for Chlorine Dioxide Residual and the 900 MudStar PLC/Computer will then add a chemistry and or a flow stream of a lighter fluid to increase and or decrease the Chlorine Dioxide Residual of the Drilling Mud.

The MudStar Process may use any of the following and or combination thereof such as the effluent liquid from the 704 Centrifuge, 821P chemicals, 603 make up water and or 604 diesel fuel to adjust the Drilling Mud Chlorine Dioxide Residual to the desired set point. These Fluids are collected and or Stored in the 811 MudStar's Effluent Holding Tank. After the initial Drilling Mud Chlorine Dioxide Residual measurement the 900 MudStar PLC/Computer will calculate the amount of Chemistries and or Cutting Fluids that will be needed to bring the Drilling Mud Chlorine Dioxide Residual into the target range.

The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Chlorine Dioxide Residual within the target range as determined by a set point. The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Chlorine Dioxide Residual of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously an optional process for measuring the S1 Density of the Drilling Mud is taking place as the Drilling Mud pass thru the initial part of the 801 thru 803 MudStar Control loop Stage 1 for the Density level the 900 MudStar PLC/Computer will then add chemistries to adjust the Density of the Drilling Mud to the desired set point. After the initial Density measurement the 900 MudStar PLC/Computer will calculate the amount of 822P Chemical that will be needed to bring the Density into the target range. The 900 MudStar PLC/Computer will know and use the Rate of Flow and the Volume of the Drilling Mud to then regulate the variable drive chemical pump to feed the proper amount of Chemistry 822 to bring the Density within the target range.

The 900 MudStar PLC/Computer will also measure the thru put of the 822P Chemical due to the 825 Flow Trackers which measures the rate and volume of the liquid leaving the variable drive 822P chemical pumps. This information from the 822P Variable Drive Chemical Pumps is collected with in the 900 MudStar PLC/Computer and then is used for Chemical Feed Verification, Consumption Rate which is the reported in hourly and or daily volumes to the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 823, 824 Flow Trackers will also be used by the 900 MudStar PLC/Computer to verify that the 819 MudStar Variable Drive Pump assigned to a designated relay that has been turned on is actually running and delivering the programmed amount of chemistries. If the 900 MudStar PLC/Computer does not receive a signal from the 823, 824 Flow Trackers within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 819, 820 chemical pump that could then be leaking on the ground and or all over the equipment and or the Drill Rig. The 900 MudStar PLC/Computer also has a 812RS MudStar Level Radar Sensor and a 812LL MudStar Low Level Sensor and a L3LL MudStar Chemical Level Sensor on top of the 819T, 820T, 821T, 822T chemical holding tanks measuring the level within the holding tanks and also on the 811 MudStar Holding Tank. These sensors are then sending this information to the 900 MudStar PLC/Computer. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

All of this is being done to the Drilling Mud as the Drilling Mud is flowing thru the 801 thru 809 MudStar Control Loop. The Drilling Mud will then pass thru a final set of sensors in the 807 thru 809 MudStar Control Loop Stage 3 and the 900 MudStar PLC/Computer will sense and or measure the Density of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

While the aforementioned process is taking place a simultaneously an optional process for measuring the S1 Hydrogen Sulfide of the Drilling Mud is taking place as the Drilling Mud pass thru the initial part of the 801 thru 803 MudStar Control loop Stage 1 for the Hydrogen Sulfide level the 900 MudStar PLC/Computer will then add chemistries to adjust the Hydrogen Sulfide of the Drilling Mud to the desired set point. After the initial Hydrogen Sulfide measurement the 900 MudStar PLC/Computer will calculate the amount of 822P Chemical that will be needed to bring the Hydrogen Sulfide into the target range. The 900 MudStar PLC/Computer will know and use the Rate of Flow and the Volume of the Drilling Mud to then regulate the variable drive chemical pump to feed the proper amount of Chemistry 822 to bring the Hydrogen Sulfide within the target range.

The 900 MudStar PLC/Computer will also measure the thru put of the 822P Chemical due to the 825 Flow Trackers which measures the rate and volume of the liquid leaving the variable drive 822P chemical pumps. This information from the 822P Variable Drive Chemical Pumps is collected with in the 900 MudStar PLC/Computer and then is used for Chemical Feed Verification, Consumption Rate which is the reported in hourly and or daily volumes to the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports. The 823, 824 Flow Trackers will also be used by the 900 MudStar PLC/Computer to verify that the 819 MudStar Variable Drive Pump assigned to a designated relay that has been turned on is actually running and delivering the programmed amount of chemistries. If the 900 MudStar PLC/Computer does not receive a signal from the 823, 824 Flow Trackers within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 819, 820 chemical pump that could then be leaking on the ground and or all over the equipment and or the Drill Rig. The 900 MudStar PLC/Computer also has a 812RS MudStar Level Radar Sensor and a 812LL MudStar Low Level Sensor and a L3LL MudStar Chemical Level Sensor on top of the 819T, 820T, 821T, 822T chemical holding tanks measuring the level within the holding tanks and also on the 811 MudStar Holding Tank. These sensors are then sending this information to the 900 MudStar PLC/Computer. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates. All of this is being done to the Drilling Mud as the Drilling Mud is flowing thru the 801 thru 809 MudStar Control Loop. The Drilling Mud will then pass thru a final set of sensors in the 807 thru 809 MudStar Control Loop Stage 3 and the 900 MudStar PLC/Computer will sense and or measure the Hydrogen Sulfide of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

While the aforementioned process is taking place a simultaneously an optional process for measuring the S1 Entrained Gases of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Entrained Gases can be established before starting any type of treatment and or adjustments.

Once the flow is sensed and a base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Entrained Gases set point as determined by the customer. The Drilling Mud will be measured and or sensed for Entrained Gases and the 900 MudStar PLC/Computer will then add a chemistry and or a flow stream of a lighter fluid to cut and or lean the Entrained Gases of the Drilling Mud.

The MudStar Process may use any of the following and or combination thereof such as the effluent liquid from the 704 centrifuge, 821P chemicals, 603 make up water and or 604 diesel fuel to adjust the Drilling Mud Entrained Gases to the desired set point. These Fluids are collected and or Stored in the 811 MudStar's Effluent Holding Tank. After the initial Drilling Mud Entrained Gases measurement the 900 MudStar PLC/Computer will calculate the amount of Chemistries and or Cutting Fluids that will be needed to bring the Drilling Mud Entrained Gases into the target range. The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Entrained Gases within the target range as determined by a set point.

The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Entrained Gases of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously an optional process for measuring the Foaming of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Foaming can be established before starting any type of treatment and or adjustments.

Once the flow is sensed and base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Foaming set point as determined by the customer. The Drilling Mud will be measured and or sensed for Foaming and the 900 MudStar PLC/Computer will then add a chemistry and or a flow stream of a lighter fluid to increase and or decrease the Foaming of the Drilling Mud. The MudStar Process may use any of the following and or combination thereof such as the effluent liquid from the 704 Centrifuge, 821P chemicals, 603 make up water and or 604 diesel fuel to adjust the Drilling Mud Foaming to the desired set point. These Fluids are collected and or Stored in the 811 MudStar's Effluent Holding Tank. After the initial Drilling Mud Foaming measurement the 900 MudStar PLC/Computer will calculate the amount of Chemistries and or Cutting Fluids that will be needed to bring the Drilling Mud Foaming into the target range. The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Foaming within the target range as determined by a set point.

The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Foaming of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously process for measuring the Water Content Percent % By Volume of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Water Content Percent % By Volume can be established before starting any type of treatment and or adjustments.

Once the flow is sensed and base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Water Content Percent % By Volume set point as determined by the customer. The Drilling Mud will be measured and or sensed for Water Content Percent % By Volume and the 900 MudStar PLC/Computer will then add a chemistry and or a flow stream of a lighter fluid to increase and or decrease the Water Content Percent % By Volume of the Drilling Mud. The MudStar Process may use any of the following and or combination thereof such as the effluent liquid from the 704 Centrifuge, 821P chemicals, 603 make up water and or 604 diesel fuel to adjust the Drilling Mud Water Content Percent % By Volume to the desired set point. These Fluids are collected and or Stored in the 811 MudStar's Effluent Holding Tank. After the initial Drilling Mud Water Content Percent % By Volume measurement the 900 MudStar PLC/Computer will calculate the amount of Chemistries and or Cutting Fluids that will be needed to bring the Drilling Mud Water Content Percent % By Volume into the target range.

The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Water Content Percent % By Volume within the target range as determined by a set point. The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Water Content Percent % By Volume of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously an optional process for measuring the S1 Oxygen Reducing Potential of the Drilling Mud is taking place as the Drilling Mud pass thru the initial part of the 801 thru 803 MudStar Control loop Stage 1 for the Oxygen Reducing Potential level the 900 MudStar PLC/Computer will then add chemistries to adjust the Oxygen Reducing Potential of the Drilling Mud to the desired set point. After the initial Oxygen Reducing Potential measurement the 900 MudStar PLC/Computer will calculate the amount of 822P Chemical that will be needed to bring the Oxygen Reducing Potential into the target range. The 900 MudStar PLC/Computer will know and use the Rate of Flow and the Volume of the Drilling Mud to then regulate the variable drive chemical pump to feed the proper amount of Chemistry 822 to bring the Oxygen Reducing Potential within the target range.

The 900 MudStar PLC/Computer will also measure the thru put of the 822P Chemical due to the 825 Flow Trackers which measures the rate and volume of the liquid leaving the variable drive 822P chemical pumps. This information from the 822P Variable Drive Chemical Pumps is collected with in the 900 MudStar PLC/Computer and then is used for Chemical Feed Verification, Consumption Rate which is the reported in hourly and or daily volumes to the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 823, 824 Flow Trackers will also be used by the 900 MudStar PLC/Computer to verify that the 819 MudStar Variable Drive Pump assigned to a designated relay that has been turned on is actually running and delivering the programmed amount of chemistries. If the 900 MudStar PLC/Computer does not receive a signal from the 823, 824 Flow Trackers within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 819, 820 chemical pump that could then be leaking on the ground and or all over the equipment and or the Drill Rig. The 900 MudStar PLC/Computer also has a 812RS MudStar Level Radar Sensor and a 812LL MudStar Low Level Sensor and a L3LL MudStar Chemical Level Sensor on top of the 819T, 820T, 821T, 822T chemical holding tanks measuring the level within the holding tanks and also on the 811 MudStar Holding Tank. These sensors are then sending this information to the 900 MudStar PLC/Computer. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

All of this is being done to the Drilling Mud as the Drilling Mud is flowing thru the 801 thru 809 MudStar Control Loop. The Drilling Mud will then pass thru a final set of sensors in the 807 thru 809 MudStar Control Loop Stage 3 and the 900 MudStar PLC/Computer will sense and or measure the Oxygen Reducing Potential of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

While the aforementioned process is taking place a simultaneously an optional process for measuring the S1 Biological Content and Loading of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Biological Content and Loading can be established before starting any type of treatment and or adjustments.

Once the flow is sensed and a base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Biological Content and Loading set point as determined by the customer. The Drilling Mud will be measured and or sensed for Biological Content and Loading and the 900 MudStar PLC/Computer will then add a chemistry and or a flow stream of a lighter fluid to cut and or lean the Biological Content and Loading of the Drilling Mud. The MudStar Process may use any of the following and or combination thereof such as the effluent liquid from the 704 centrifuge, 821P chemicals, 603 make up water and or 604 diesel fuel to adjust the Drilling Mud Biological Content and Loading to the desired set point. These Drilling Fluids are collected and or Stored in the 811 MudStar's Effluent Holding Tank. After the initial Drilling Mud Biological Content and Loading measurement the 900 MudStar PLC/Computer will calculate the amount of Chemistries and or Cutting Fluids that will be needed to bring the Drilling Mud Biological Content and Loading into the target range.

The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Biological Content and Loading within the target range as determined by a set point. The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Biological Content and Loading of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously an optional process for measuring the Corrosion General Metal Specific Rates of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Corrosion General Metal Specific Rates can be established before starting any type of treatment and or adjustments.

Once the flow is sensed and base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Corrosion General Metal Specific Rates set point as determined by the customer. The Drilling Mud will be measured and or sensed for Corrosion General Metal Specific Rates and the 900 MudStar PLC/Computer will then add a chemistry and or a flow stream of a lighter fluid to increase and or decrease the Corrosion General Metal Specific Rates of the Drilling Mud. The MudStar Process may use any of the following and or combination thereof such as the effluent liquid from the 704 Centrifuge, 821P chemicals, 603 make up water and or 604 diesel fuel to adjust the Drilling Mud Corrosion General Metal Specific Rates to the desired set point. These Fluids are collected and or Stored in the 811 MudStar's Effluent Holding Tank. After the initial Drilling Mud Corrosion General Metal Specific Rates measurement the 900 MudStar PLC/Computer will calculate the amount of Chemistries and or Cutting Fluids that will be needed to bring the Drilling Mud Corrosion General Metal Specific Rates into the target range.

The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Corrosion General Metal Specific Rates within the target range as determined by a set point. The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Corrosion General Metal Specific Rates of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

While the aforementioned process is taking place a simultaneously process for measuring the Corrosion Pitting Percentage Metal Specific Rates of the Drilling Mud is taking place as the Drilling Mud pass thru the initial part of the 801 thru 803 MudStar Control loop Stage 1. This information is being reported to the 900 MudStar PLC/Computer and is then used to determine if the Drilling Mud is in need of adjustment before being sent to the 704 Centrifuge. During this initial flow event the default setting for the Drilling Mud will be to send it back to the 600 Drilling Mud Reserve Pit and or a proportionate flow right back to the suction Line B, 700 line on the inlet of the 701 centrifuge pump. This way a base line of the Drilling Mud Corrosion Pitting Percentage Metal Specific Rates can be established before starting any type of treatment and or adjustments.

Once the flow is sensed and base line has been verified by the 900 MudStar PLC/Computer, then the 900 MudStar PLC/Computer Unit will start sending flow through the second part of the 804 thru 806 MudStar Control Loop Stage 2 for treatment and conditioning of the Drilling Mud. The Drilling Mud can be altered and or controlled by a Drilling Mud Corrosion Pitting Percentage Metal Specific Rates set point as determined by the customer. The Drilling Mud will be measured and or sensed for Corrosion Pitting Percentage Metal Specific Rates and the 900 MudStar PLC/Computer will then add a chemistry and or a flow stream of a lighter fluid to increase and or decrease the Corrosion Pitting Percentage Metal Specific Rates of the Drilling Mud. The MudStar Process may use any of the following and or combination thereof such as the effluent liquid from the 704 Centrifuge, 821P chemicals, 603 make up water and or 604 diesel fuel to adjust the Drilling Mud Corrosion Pitting Percentage Metal Specific Rates to the desired set point. These Fluids are collected and or Stored in the 811 MudStar's Effluent Holding Tank. After the initial Drilling Mud Corrosion Pitting Percentage Metal Specific Rates measurement the 900 MudStar PLC/Computer will calculate the amount of Chemistries and or Cutting Fluids that will be needed to bring the Drilling Mud Corrosion Pitting Percentage Metal Specific Rates into the target range.

The 900 MudStar PLC/Computer will know the Rate Of Flow and the Volume Of The Drilling Mud and can therefore regulate the 821P Variable Drive Chemical Pump and or 816, 817, VDV102, 800 Proportional Valve to feed the proper amount of Chemistry and or Cutting Fluids to bring the Drilling Mud Corrosion Pitting Percentage Metal Specific Rates within the target range as determined by a set point. The 900 MudStar PLC/Computer will also measure the thru put of the Chemistries due to the 821 Flow Trackers and or the 813, 816 Cutting Fluids Flow Meter which measures the rate and volume of the liquid leaving the variable drive chemical pump and or transferred pump off of the 811 MudStar Effluent Holding Tank. This information from the 820P Variable Drive Chemical Pump and or 816, 813 Flow Meter is collected with in the 900 MudStar PLC/Computer and then is used for Chemical Feed Verification, Cutting Fluid Feed Verification, Consumption Rate which is the reported in hourly and or daily volumes on the 900 MudStar PLC/Computer and also the 1000 SmartStar Server. These hourly and daily volumes can have high and low set points which if are and or are not met will then trigger any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 825 Flow Tracker and or 816, 817 Flow Meter will also be used by the 900 MudStar PLC/Computer to verify that the Pump and or Pumps assigned to a designated relay and or relays that has been turned on is actually running and delivering the programmed amount of Chemistries and or Cutting Fluids. If the 900 MudStar PLC/Computer does not receive a signal from the 825 Flow Tracker and or 816, 817 Flow Meter within a programmed set point, the 900 MudStar PLC/Computer will send any number of alarms and or reports from 902IL visual lights and or strobes, 903AS Auditable buzzer and or sirens and or use the 1010 SmartStar Server Communications using anyone of and or combinations of 1012EM SmartStar Server Emails, 1013VM SmartStar Server Voicemail, 1011TM SmartStar Text Messages and or 1014CG SmartStar Customer Graph Trend Reports.

The 900 MudStar PLC/Computer can then also disable the relay to stop the running of a 821P Chemical Pump and or 815, 814 Transfer Pump that could then be leaking on the ground and or all over the equipment and or Drill Rig. The 900 MudStar PLC/Computer also has a sensor on top of the 821T Chemical Holding tank and the 811 MudStar Effluent Holding Tank measuring the level within the holding tanks and is the sending this information to the 900 MudStar PLC/Computer and the 1000 SmartStar Server. This information is used in a number of ways one to report current inventories, consumption rates, reorder points for inventory control and to insure system is not without product due to delivery times and or schedules and this information is also used by the 900 MudStar PLC/Computer to verify and determine PPM part per million feed rates.

As all of this is being done to the Drilling Mud, the Drilling Mud will then pass thru a final set of sensors in the 804 thru 806 MudStar Control Loop Stage 2 and or 807 thru 809 MudStar Control Loop Stage 3 and the 900 MudStar PLC/Computer will sense and or measure the Corrosion Pitting Percentage Metal Specific Rates of the Drilling Mud and therefore insure that the conditions and the set points are met, that were programmed into the 900 MudStar PLC/Computer by the Drilling Rig Designated Operator and or any number of personnel either locally at the 900 MudStar PLC/Computer and or remote through the 1000 SmartStar Server.

The Drilling Mud that has been measured, treated and verified is now sent to the 704 centrifuge where the solids will be cut/removed which the fall down the 705 Centrifuge Solids Effluent Slide to per collected 706 Centrifuge Solids Holding Tank for removable from the drilling site. The liquid effluent from the 704, Line F Centrifuge will be sent to a 811 MudStar Centrifuge Effluent Holding Tank and stored until there is sufficient volume to pump back into the 601, line I Drilling Rigs Suction Pit. The amount of effluent that is being returned to the 601 Drilling Rigs Suction Pit is being measured by the 817 MudStar Flow Sensors and reporting this information back to the 900 MudStar PLC/Computer that can report on the efficiency of the 704 Centrifuge and also report on the amount of water and diesel fuel that is now reusable.

The invention claimed is:

1. A method for monitoring drilling mud properties, the drilling mud being transported through a well drilling system and stored in a mud pit, the method comprising:

directing a flow of drilling mud from the mud pit to a control loop comprising at least one sensor for at least one property of the drilling mud;

automatically and in real time, sensing the at least one property of the flow of drilling mud to obtain a condition value;

determining if the condition value is within a set point range for the at least one property of the flow of drilling mud;

directing the flow of drilling mud to the mud pit if the condition value is within the set point range; or directing the flow of drilling mud to a centrifuge for adjustment of the property of the flow of drilling mud if the condition value is outside the set point range and then returning the flow of drilling mud from the centrifuge to the mud pit after the mud property has been adjusted.

2. The method of claim 1 wherein the at least one property of the flow of drilling mud is selected from the group of properties consisting of:

pH;
density;
weight;
viscosity;
% solids;
water content % by volume;
dissolved oxygen;
hydrogen sulfide;
foaming condition;
entrained gases;
biological content and loading;
free and total chlorine;
free and total bromine;
chlorine dioxide;
oxygen reducing potential;
conductivity;
temperatures;
flow rate;
flow volume;
corrosion general metal specific rates; and
% corrosion pitting.

3. The method of claim 1, further including monitoring at least one operational parameter of the centrifuge, wherein said at least one operational parameter is selected from the group consisting of:

centrifuge efficiency;
volume and flow rate of drilling mud to the centrifuge;
volume and flow rate of effluent from the centrifuge; and
volume of centrifuge solids removal.

4. The method of claim 1 wherein adjustment of the at least one property of the flow of drilling mud includes:

adding, under control of at least one pump, at least one fluid to the flow of drilling mud, wherein the at least one fluid is selected from the group of fluids consisting of:

clean water;
polymers;
make up water;
diesel fuel;
acid;
polymer; and
chemicals.

5. The method of claim 4 and further including monitoring parameters of the at least one fluid to be added to the flow of drilling mud, wherein the parameters of the at least one fluid are selected from the group consisting of:

volume and consumption of make up water;
volume and consumption of make up diesel fuel;
volume and consumption of caustic;
volume and consumption of acid;
volume and consumption of polymer; and
volume and consumption of chemicals.

6. The method of claim 4 and further monitoring the operation of the at least one pump for adding the at least one fluid.

7. The method of claim 4 and further monitoring the properties of fluids stored at the well drilling system site, which properties and fluids are selected from the group consisting of:

quantity and level of caustic;
quantity and level of acid; and
quantity and level of polymer.

8. The method of claim 1 and further including:

displaying parameters of the flow of drilling mud to well drilling operators at sites remote from the well drilling system.

9. The method of claim 1 and further including:

transmitting parameters of the flow of drilling mud to well drilling operators at sites remote from the well drilling system.

10. The method of claim 1 and further including setting the set point range from sites remote from the well drilling system.

* * * * *